US009285729B2

(12) United States Patent
Saito et al.

(10) Patent No.: US 9,285,729 B2
(45) Date of Patent: Mar. 15, 2016

(54) IMAGE FORMING APPARATUS INCLUDING TEMPERATURE DETECTION PROCESSING OF A FIXING MEMBER

(71) Applicant: CANON KABUSHIKI KAISHA, Tokyo (JP)

(72) Inventors: Hiroshi Saito, Kashiwa (JP); Kenichi Tanaka, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/596,071

(22) Filed: Jan. 13, 2015

(65) Prior Publication Data

US 2015/0205236 A1 Jul. 23, 2015

(30) Foreign Application Priority Data

Jan. 21, 2014 (JP) ..... 2014-008935
Dec. 17, 2014 (JP) ..... 2014-255164

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69
See application file for complete search history.

(56) References Cited

U.S. PATENT DOCUMENTS 7,062,187 B2 * 6/2006 Peng et al. ..... 399/69
7,668,473 B2 * 2/2010 Nakajima et al. ..... 399/69
7,778,564 B2 * 8/2010 Sone et al. ..... 399/69
8,509,666 B2 * 8/2013 Kobayashi et al. ..... 399/327
8,718,502 B2 * 5/2014 Yuasa et al. ..... 399/69

FOREIGN PATENT DOCUMENTS

JP 2003-57116 A 2/2003

* cited by examiner

*Primary Examiner* — William J Royer
(74) *Attorney, Agent, or Firm* — Canon USA, Inc. IP Division

(57) ABSTRACT

An image forming apparatus includes a fixing unit having a heater, and a fixing member, the fixing unit configured to fix an image onto a recording material, a film configured to increase its temperature by absorbing infrared rays, a first sensor configured to measure a temperature of the film, a holding member configured to hold the film, a second sensor configured to measure a temperature of the holding member, a storage unit for storing a plurality of temperature determination information, a selection unit configured to select temperature determination information to interest, based on the measurement results of the first and the second sensor, from among the plurality of the stored temperature determination information, and a determination unit configured to determine a temperature of the fixing unit using the temperature determination information to interest selected by the selection unit, based on the measurement results of the first and the second sensor.

17 Claims, 10 Drawing Sheets

FIG.6

TEMPERATURE DIFFERENCE SMALL → TEMPERATURE DIFFERENCE LARGE

HIGH TEMPERATURE ↑ LOW TEMPERATURE

| $V_{film}$ \ $V_{def}$ | … | $a_d$ | … | $b_d$ | … | $c_d$ | … | $d_d$ | … |
|---|---|---|---|---|---|---|---|---|---|
| ⋮ | | | | | | | | | |
| $a_f$ | | 190°C | | 180°C | | 110°C | | | |
| ⋮ | | | | | | | | | |
| $b_f$ | | 200°C | | 230°C | | | | 100°C | |
| ⋮ | | | | | | | | | |
| $c_f$ | | | | 110°C | | 80°C | | | |
| ⋮ | | | | | | | | | |
| $d_f$ | | 40°C | | 60°C | | | | | |
| ⋮ | | | | | | | | | |

FIG.7

HIGH TEMPERATURE ← LOW TEMPERATURE

HIGH TEMPERATURE ↑ LOW TEMPERATURE

| $V_{case}$ \ $V_{film}$ | … | $a_f$ | … | $b_f$ | … | $c_f$ | … |
|---|---|---|---|---|---|---|---|
| ⋮ | | | | | | | |
| $a_c$ | | 55°C | | 30°C | | 10°C | |
| ⋮ | | | | | | | |
| $b_c$ | | 60°C | | 40°C | | 20°C | |
| ⋮ | | | | | | | |
| $c_c$ | | 80°C | | 55°C | | 30°C | |
| ⋮ | | | | | | | |

(* $a_f < a_c$)

IMAGE FORMING APPARATUS INCLUDING TEMPERATURE DETECTION PROCESSING OF A FIXING MEMBER

BACKGROUND OF THE INVENTION

1. Field of the Invention

The present invention relates to temperature detection processing of a fixing member.

2. Description of the Related Art

In electro-photographic image forming apparatuses, a toner image transferred onto a recording material is fixed by a fixing device. The fixing device includes a fixing member having a heater, and a sensor for detecting a surface temperature of the fixing member. To keep the surface of the fixing member at a temperature (target temperature) at which the toner melts, based on the surface temperature of the fixing member detected by the sensor, a power supply of the heater is controlled.

As the sensor for detecting the temperature of the fixing member, a noncontact temperature detection element is used so as not to damage the surface of the fixing member. Japanese Patent Application Laid-Open No. 2003-57116 discusses a noncontact temperature detection device having a film for absorbing infrared rays emitted according to a surface temperature of a fixing member, and generating heat according to the amount of the absorbed infrared rays. The temperature detection device detects a surface temperature of the fixing member based on a value obtained by subtracting a temperature of an infrared absorbing film supporting member detected by one thermistor, from a temperature of the infrared absorbing film detected by another thermistor. More specifically, a surface temperature of the fixing member is determined based on a temperature difference between a detected temperature of the infrared absorbing film and a detected temperature of the supporting member, and the detected temperature of the infrared absorbing film, by referring to a data table. The temperature difference between the detected temperature of the infrared absorbing film and the detected temperature of the supporting member is calculated because an analog-to-direct (A/D) converter converts an output voltage of the thermistor element from an analog value to a digital value, and thereby the ability (resolution) to detect surface temperatures is restricted.

In this technique, the analog circuit is designed on the assumption that the temperature of the infrared absorbing film is higher than the temperature of the supporting member, and further, the data table is determined based on this assumption. Consequently, when the detected temperature of the thermistor provided on the infrared absorbing film is lower than the detected temperature of the thermistor provided on the supporting member, the device makes an incorrect decision that one of the thermistors is out of order. Consequently, when the temperature detected by the thermistor provided on the infrared absorbing film is lower than the temperature detected by the thermistor provided on the supporting member, the device may not detect the temperature of the fixing member.

For example, when the fixing member is replaced, the temperature of the infrared absorbing film rapidly decreases. On the other hand, the temperature of the holding member gradually decreases. That is, it is possible that, immediately after the replacement of the fixing member, the temperature detected by the thermistor provided on the infrared absorbing film may be lower than the temperature detected by the thermistor provided on the supporting member.

SUMMARY OF THE INVENTION

According to an aspect of the present invention, an image forming apparatus includes a fixing unit having a heater, and a fixing member configured to be heated by the heater. The fixing unit is configured to heat a recording material bearing an image using the fixing member so that the image is fixed on the recording material. Further, the image forming apparatus includes a film provided in non-contact with the fixing member. The film is configured to increase its temperature by absorbing infrared rays emitted from the fixing member. Further, the image forming apparatus includes a first sensor configured to measure a temperature of the film, a holding member configured to hold the film, a second sensor configured to measure a temperature of the holding member, a storage unit for storing a plurality of pieces of temperature determination information of different corresponding relations among information about measurement results of the first sensor and measurement results of the second sensor and the temperature of the fixing member, a selection unit configured to select temperature determination information for determining a temperature of the fixing member, based on the measurement results of the first sensor and the measurement results of the second sensor, from among the plurality of pieces of the temperature determination information stored in the storage unit, and a determination unit configured to determine a temperature of the fixing member using the temperature determination information selected by the selection unit, based on the measurement results of the first sensor and the measurement results of the second sensor.

Further features of the present invention will become apparent from the following description of exemplary embodiments with reference to the attached drawings.

BRIEF DESCRIPTION OF THE DRAWINGS

FIG. 6 is a first data table for detecting a temperature of a fixing member.

FIG. 7 is a second data table for detecting a temperature of the fixing member.

DESCRIPTION OF THE EMBODIMENTS

Figure 1:
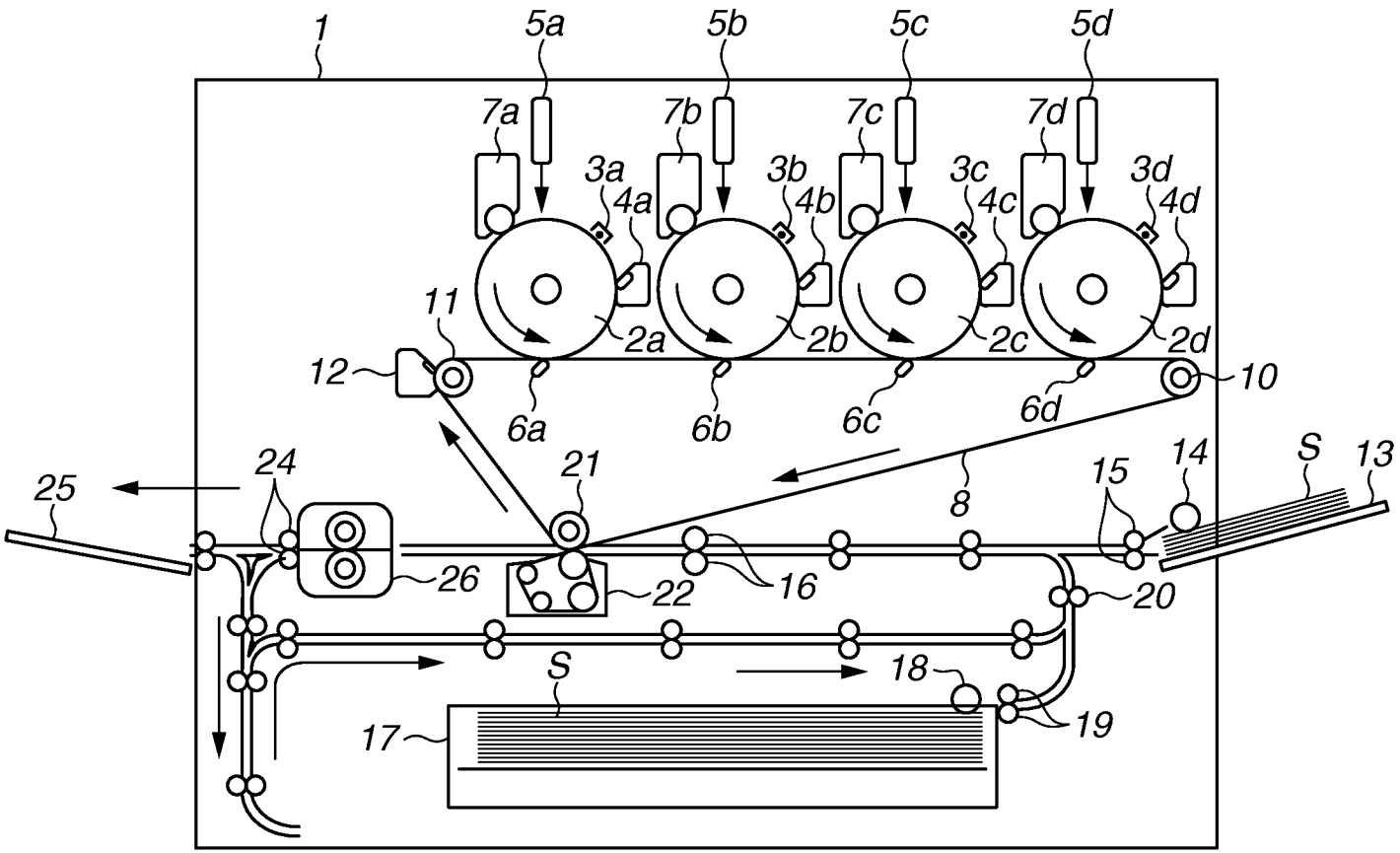
FIG. 1 is a schematic cross-sectional view illustrating an image forming apparatus.

The first exemplary embodiment is described below. FIG. 1 is a cross-sectional view illustrating an image forming apparatus (printer 1). In FIG. 1, the printer 1 includes photosensitive drums 2*a* to 2*d* of four colors, chargers 3*a* to 3*d*, photosensitive drum cleaners 4*a* to 4*d*, and laser scanning units 5*a* to 5*d*. The printer 1 further includes primary transfer blades 6*a* to 6*d*, developing units 7*a* to 7*d*, an intermediate transfer belt 8, rollers 10, 11, and 21 that support the intermediate transfer belt 8, and an intermediate transfer belt cleaner 12.

A sheet cassette 17 stores a recording material S. Pickup rollers 18 and 19 are used to feed the recording material S stored in the sheet cassette 17. Vertical pass rollers 20 convey the recording material S. A manual feed tray 13 stores the recording material S such as paper. Pickup rollers 14 and 15 are used to feed the recording material S stored in the manual feed tray 13. Registration rollers 16 are used to adjust timing for sending the recording material S.

The printer 1 further includes a secondary transfer unit 22, a fixing unit 26, discharge rollers 24, and a discharge tray 25.

In the printer 1, on the photosensitive drums 2*a* to 2*d*, electrostatic latent images are formed by the laser scanning units 5*a* to 5*d*, and the electrostatic latent images are developed by the developing units 7*a* to 7*d*. The developing units 7*a* to 7*d* form toner images of the individual colors on the individual photosensitive drums 2*a* to 2*d*. The toner images of the individual colors developed on the photosensitive drums 2*a* to 2*d* are transferred onto the intermediate transfer belt 8, where the toner images of each color are superimposed to form a full-color toner image.

The recording material S is fed from the sheet cassette 17 or the manual feed tray 13, and its registration timing is adjusted by the registration rollers 16, and conveyed to the secondary transfer unit 22. A plurality of stepping motors drive a sheet conveyance unit including the pickup rollers 18 and 19 for feeding the paper from the sheet cassette 17, the vertical pass rollers 20, the registration rollers 16, and the pickup rollers 14 and 15 for feeding the paper from the manual feed tray 13.

The toner image on the intermediate transfer belt 8 and the recording material S pass through the secondary transfer unit 22 and thereby the toner image on the intermediate transfer belt 8 is transferred onto the recording material S. The recording material S on which the toner image is transferred is conveyed to the fixing unit 26. The fixing unit 26 conveys the recording material S carrying a toner image T while applying heat and pressure onto the recording material S to fix the toner image T on the recording material S. The recording material S on which the toner image T has been fixed is discharged from the printer 1.

Figure 2:
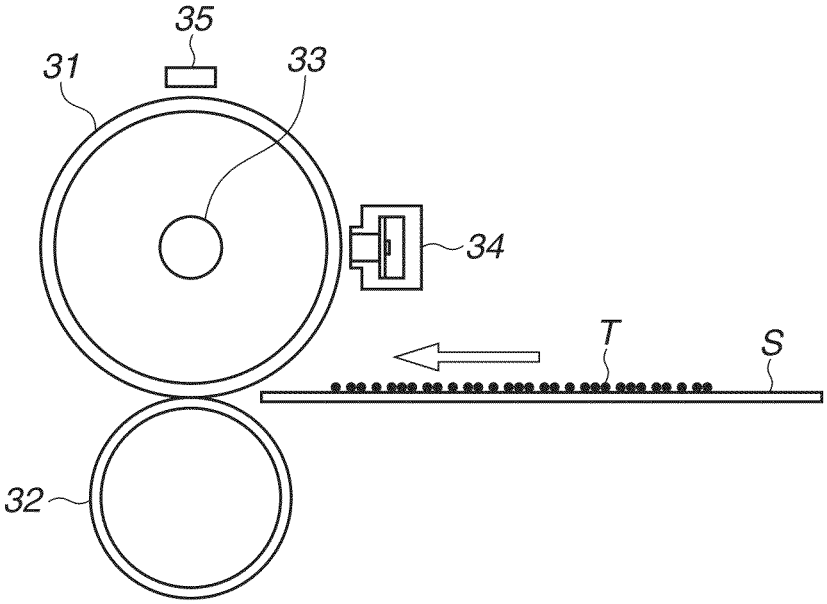
FIG. 2 illustrates a schematic structure of a fixing device.

FIG. 2 illustrates a schematic structure of the fixing unit 26. A heating roller 31 is formed of a layer of a heat-resistant elastic member of silicone rubber, fluoro rubber, or the like on a pipe member of aluminum, iron, or the like, and its surface is covered with a release layer of perfluoroalkoxy (PFA), polytetrafluoroethylene (PTFE), or the like.

The fixing unit 26 includes a pressure roller 32 for pressing the heating roller 31. The pressure roller 32 is formed, similarly to the heating roller 31, by forming a layer of a heat-resistant elastic member of silicone rubber, fluoro rubber, or the like on a core bar. The pressure roller (pressing member) 32 presses the heating roller (fixing member) 31 and thereby a nip portion is formed. The recording material S passes through the nip portion and the toner image T on the recording material S is heated and pressed, and thereby the toner image T is fixed onto the recording material S.

The heating roller 31 includes a heater 33 to heat the heating roller 31 from the inside. A temperature detection element 34 for detecting a surface temperature of the heating roller 31 is disposed in a noncontact manner at a position opposite to the heating roller 31. Based on an output signal from the temperature detection element 34, a power supply to the heater 33 is controlled such that a surface temperature of the heating roller 31 is maintained at a fixing temperature, or a standby temperature in a non-fixing state. On the heating roller 31, a thermoswitch 35 is provided in a noncontact manner to detect overheating. When overheating of the heating roller 31 is detected, power supply to the heater 33 is shut off.

Figure 3:
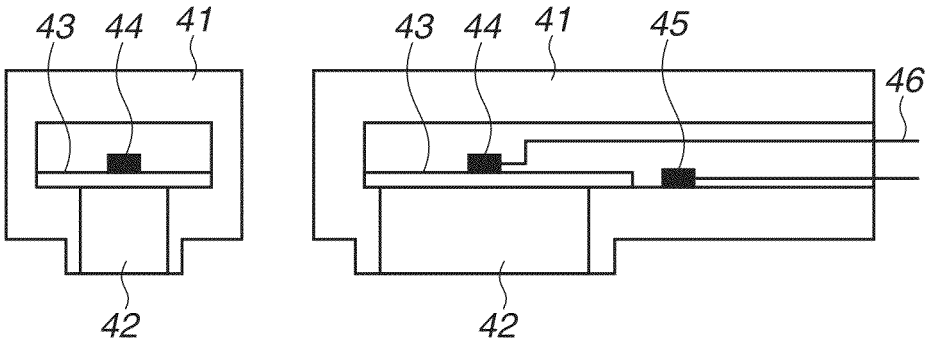
FIG. 3 illustrates a schematic structure of a temperature detection sensor.

With reference to FIG. 3, a structure of the temperature detection element 34 is described. A case 41 is formed of a material having high thermal conductivity such as aluminum. An opening 42 is provided on one surface of the case 41. An infrared absorbing film 43 that absorbs infrared rays emitted from the heating roller 31 is provided on the opening 42 such that the infrared absorbing film 43 blocks the opening 42. The case 41 is a supporting member for supporting the infrared absorbing film 43.

The infrared absorbing film 43 is a film member, and a temperature of the film increases according to an amount of the infrared rays absorbed by the film. A thermistor 44 is fixed on the infrared absorbing film 43 using an adhesive. Near the thermistor 44, a thermistor 45 for measuring an atmosphere temperature in the case 41 is provided. Lead wires 46 of the thermistor 44 and the thermistor 45 are respectively connected to sockets (not illustrated) provided in the case 41.

The thermistor 45 indicates a resistance value change according to temperatures (case temperatures) of the case 41 corresponding to ambient temperature of the temperature detection element 34. The thermistor 44 outputs a signal corresponding to a temperature (film temperature) of the infrared absorbing film 43 for absorbing infrared rays emitted from a measure target (heating roller 31). The temperature of thermistor 44 increases by the amount of the temperature increase due to the absorbed infrared rays, from the case temperature detected by the thermistor 45.

Figure 4:
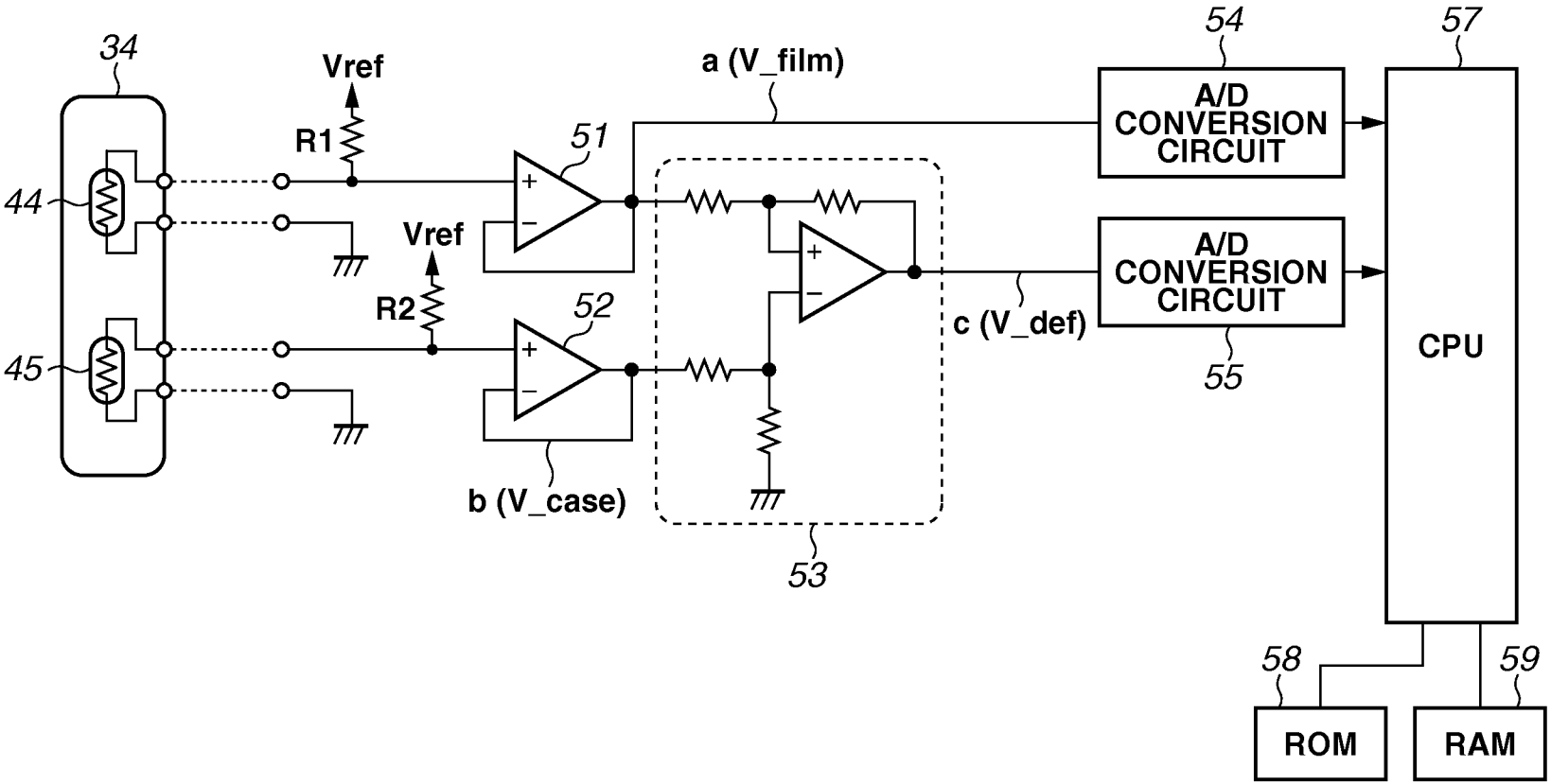
FIG.4 Prior Art
FIG. 4 is a schematic view illustrating main components of a detection circuit in a known temperature detection sensor.

FIG. 4 illustrates a circuit configuration of the temperature detection element 34 according to a known technology. In FIG. 4, a central processing unit (CPU) 57 is a control circuit for controlling electric power supply to the heater 33 based on a temperature of the heating roller 31 detected by the temperature detection element 34. A read-only memory (ROM) 58 is a recording unit for storing various kinds of data. A random access memory (RAM) 59 is a system work memory. The ROM 58 stores data (FIG. 6) indicating a corresponding relation between combinations of V_film and V_def, which are described below, and the surface temperature of the heating roller 31.

The thermistor 44 is connected with a resistance element R1 in series. The resistance element R1 is connected with a reference voltage Vref. With this configuration, a voltage at the contact point of the thermistor 44 and the resistance element R1 is output as a signal a (V_film) via an operational amplifier functioning serving as a voltage follower circuit 51.

Similarly, the thermistor 45 is connected with a resistance element R2 in series. The resistance element R2 is connected with the reference voltage Vref. With this configuration, a voltage at the contact point of the thermistor 45 and the resistance element R2 is output as a signal b (V_case) via an operational amplifier functioning as a voltage follower circuit 52. The resistance value of the thermistors 44 and 45 decreases as the detected temperature increases, and consequently, as the detected temperature increases, the output voltage (V_film, V_case) decreases.

A differential amplifier circuit 53 is an output circuit for outputting a signal c (V_def) generated by amplifying a difference value of an input V_case and an input V_film by 10 times. The difference between the output values of the thermistors 44 and 45 is amplified by the differential amplifier circuit 53 because the difference between the film temperature and the case temperature is very small.

The value of V_film is converted through analog to digital (A/D) conversion by an A/D conversion circuit 54, and the value of V_def is converted through A/D conversion by an A/D conversion circuit 55, respectively, and the values are input as digital signals to the CPU 57. The CPU 57 detects a temperature of the heating roller 31 when a film temperature is higher than a case temperature by referring to the data in FIG. 6. When a film temperature is lower than a case temperature, the CPU 57 detects a temperature of the heating roller 31 by referring to the data in FIG. 7. The CPU 57 controls the amount of power supply to the heater 33 such that the temperature of the heating roller 31 corresponds with a target temperature.

Figure 5:
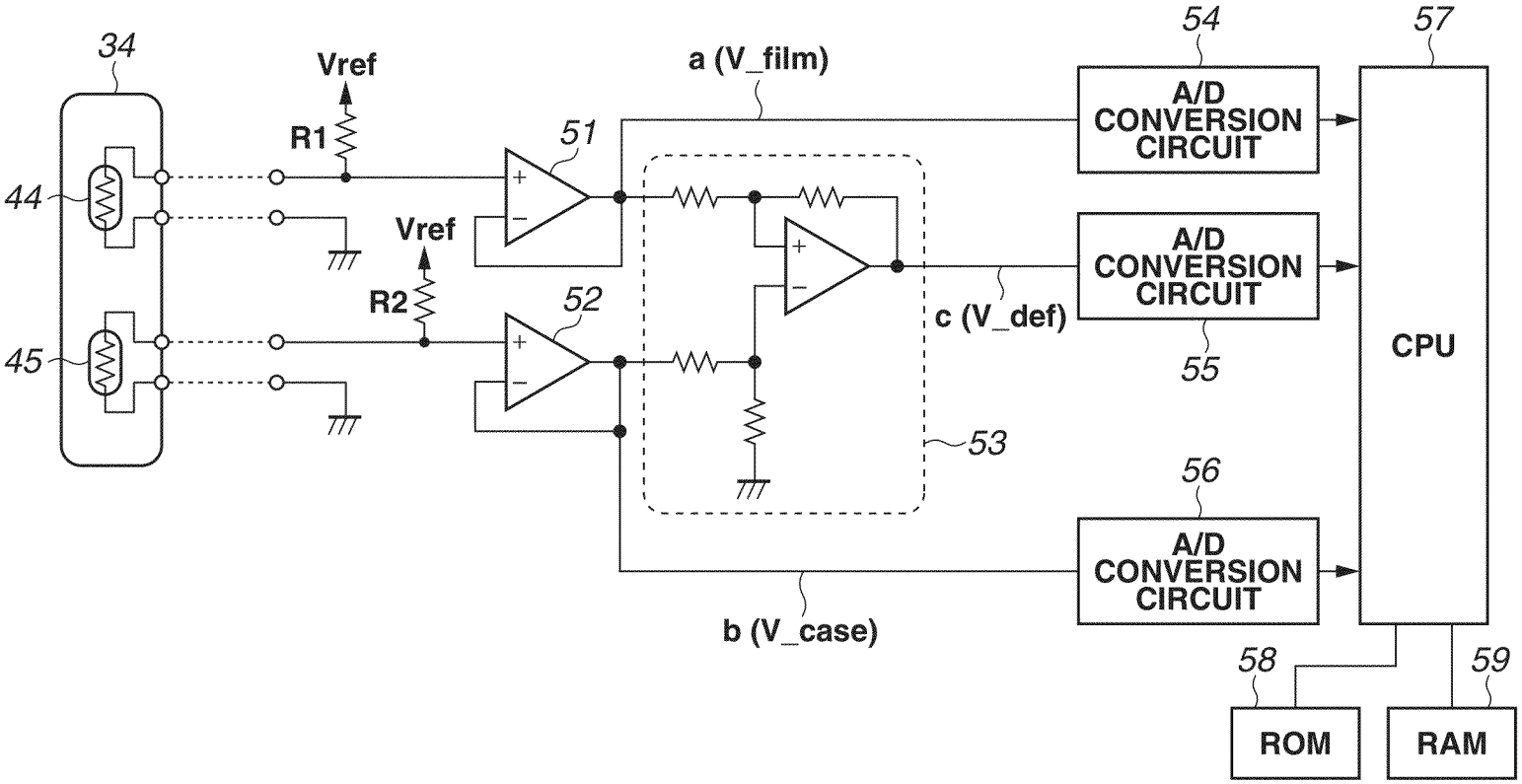
FIG. 5 is a schematic view illustrating main components of a detection circuit in a temperature detection sensor according to a first exemplary embodiment.

FIG. 5 illustrates a circuit configuration of the temperature detection element 34 according to the exemplary embodiment. In FIG. 5, the CPU 57 is a circuit for controlling electric power supply to the heater 33 based on a temperature of the heating roller 31 detected by the temperature detection element 34. The ROM 58 is a recording unit storing various kinds of data. The RAM 59 is a system work memory. The ROM 58 stores the data (FIG. 6) indicating the correspondence relation between the combinations of V_film and V_def and the surface temperature of the heating roller 31, and further stores data (FIG. 7) which indicates a corresponding relation between combinations of V_film and V_case and the surface temperature of the heating roller 31.

To components similar to those in the known temperature detection element 34 (FIG. 4), the same reference numerals are applied, and their descriptions are omitted.

A difference between the temperature detection element 34 (FIG. 5) according to the present exemplary embodiment and the known temperature detection element 34 (FIG. 4) is that the output value V_case indicating a case temperature is input to the CPU 57. The value of V_case is converted through A/D conversion by the A/D conversion circuit 56, and input as a digital signal in the CPU 57.

In this exemplary embodiment, the CPU 57 detects a surface temperature of the heating roller 31 based on a film temperature and a case temperature even if the case temperature is higher than the film temperature, that is, V_film is larger than V_case.

Hereinafter, a method of detecting a surface temperature of the heating roller 31 when V_film is larger than V_case is described.

FIG. 7 is a schematic view illustrating data (reversion data) to be referred to when the CPU 57 detects a surface temperature of the heating roller 31 in a case where V_film is larger than V_case. As illustrated in FIG. 7, in the reversion data, without using V_def, based on V_film and V_case, a surface temperature of the heating roller 31 is detected. That is because the values of V_def are minus values, and their absolute values are increasing, therefore, the values converted by the A/D conversion circuit 55 may not be correct values.

In this exemplary embodiment, however, the CPU 57 detects a surface temperature of the heating roller 31 based on V_def and V_film when a film temperature is higher than a case temperature, that is, when V_film is smaller than V_case.

In other words, in a state of V_case≥V_film, that is, V_def<0, it is not possible to detect a roller temperature. Meanwhile, in the reversion table (FIG. 7), when a very small difference between V_film and V_case is to be detected, due to the restrictions on the resolution of the A/D conversion circuits 54, 55, and 56, it is difficult to obtain a detection temperature of a sufficient resolution.

To solve the problem, in this exemplary embodiment, the CPU 57 selectively switches tables to be referred to depending on a difference (V_def) between V_film and V_case.

Figure 8:
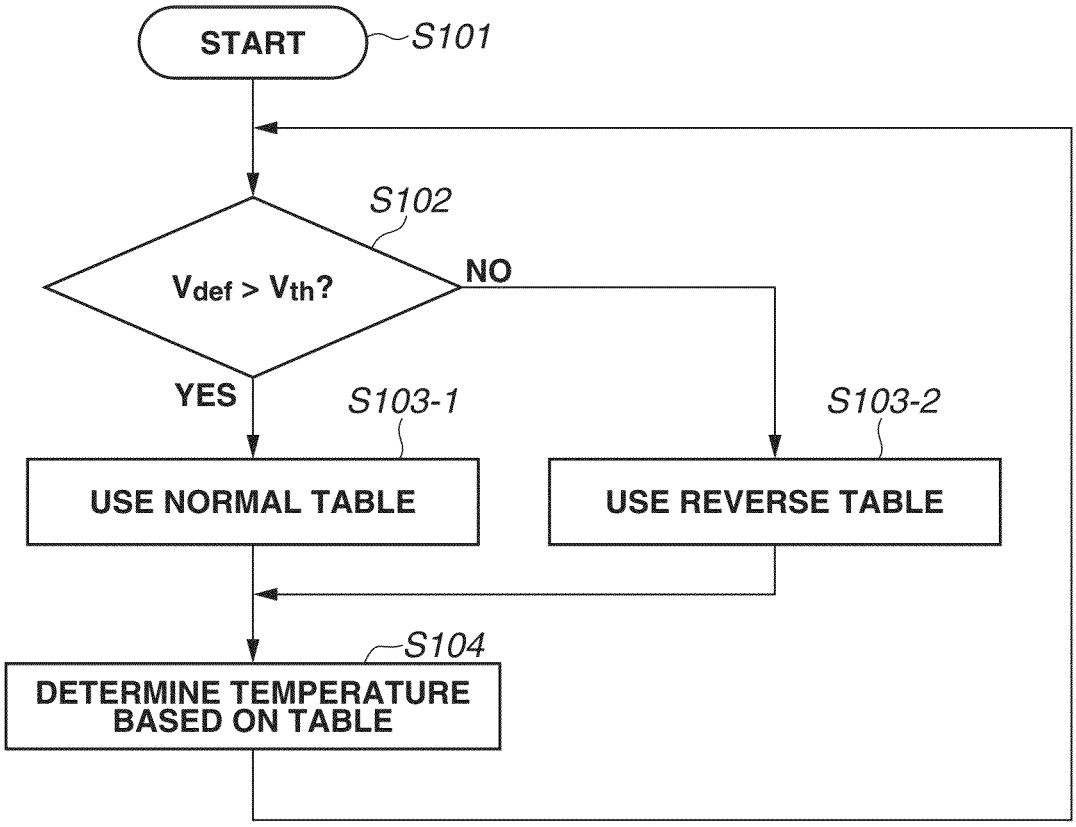
FIG. 8 is a flowchart illustrating temperature detection processing in an image forming apparatus.

With reference to FIG. 8, the temperature detection processing according to the exemplary embodiment is described. In response to the start of power supply to the heater 33, the CPU 57 executes the flowchart of the temperature detection processing illustrated in FIG. 8. The CPU 57 starts the power supply to the heater 33 to control the temperature of the heating roller 31, and then, regularly detects the surface temperature of the heating roller 31.

In step S101, the CPU 57 starts the temperature detection, and in step S102, the CPU 57 determines whether V_def is larger than a threshold value Vth. The value of V_def is calculated by the following equation (1).

$$V_def=(V_case-V_film)\times 10 \quad (1).$$

In step S102, if V_def>Vth (YES in step S102), the CPU 57 determines that V_film is sufficiently lower than V_case. That is, the CPU 57 determines that the film temperature is higher than the case temperature.

In step S103-1, the CPU 57 selects the data illustrated in FIG. 6. In step S104, the CPU 57 refers to the data (FIG. 6), and detects a surface temperature of the heating roller 31. After the detection of the surface temperature of the heating roller 31 by the CPU 57, the processing proceeds to step S102. Although not illustrated in FIG. 8, the CPU 57 controls the amount of the power supply to the heater 33 based on the temperature of the heating roller 31 detected in step S104 and a target temperature.

In step S102, if V_def≤Vth (NO in step S102), the CPU 57 determines that a difference between V_case and V_film is approximately zero, that is, there is substantially no difference between the case temperature and the film temperature, or determines that V_case is lower than V_film, that is, the case temperature is higher than the film temperature.

In this exemplary embodiment, in consideration of a detection error due to individual differences of the thermistors 44 and 45, and individual differences of the detecting circuit, the threshold value Vth is set to, for example, 0.5 [V]. Alternatively, the threshold value Vth can be set to zero.

In step S102, if V_def≤Vth, in step S103-2, the CPU 57 selects the data (reversion data) illustrated in FIG. 7. In step S104, the CPU 57 refers to the data (FIG. 7), and detects a surface temperature of the heating roller 31. The CPU 57 detects the surface temperature of the heating roller 31, and the processing proceeds to step S102. Although not illustrated in FIG. 8, the CPU 57 controls the amount of the power supply to the heater 33 based on the temperature of the heating roller 31 detected in step S104 and the target temperature.

Figure 9A:
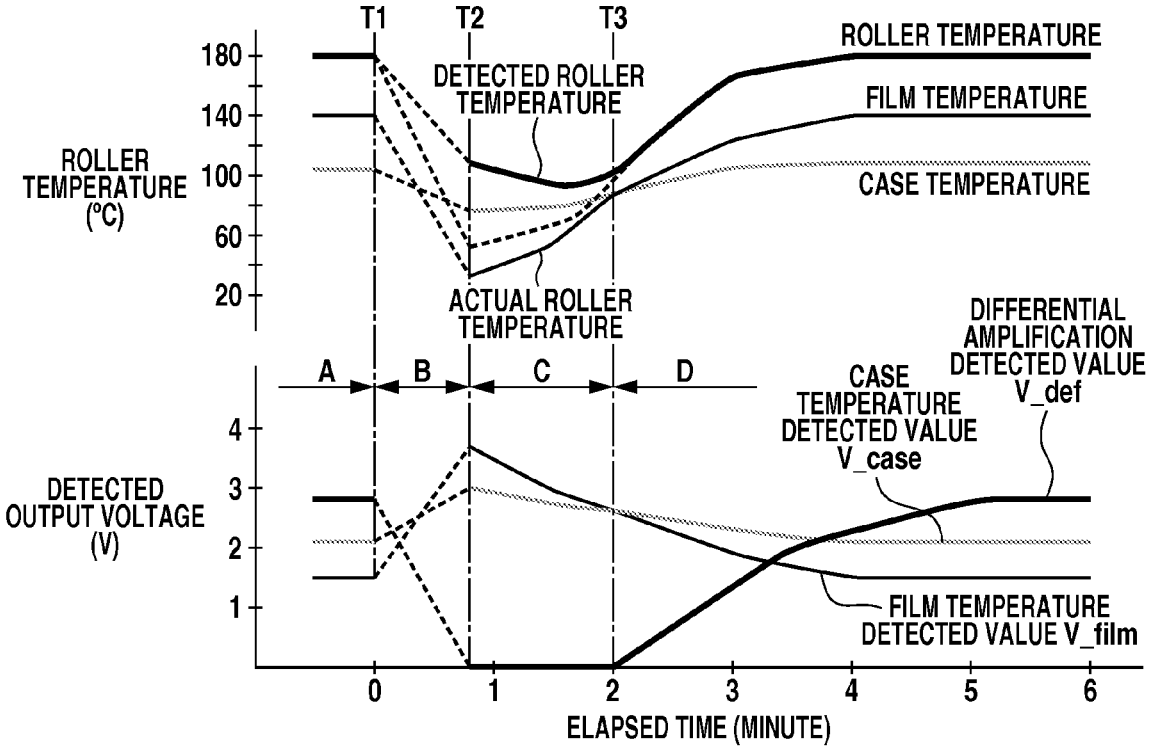
FIG.9A Prior Art
FIG. 9A illustrates temperatures of a heating roller detected by the known temperature detection sensor and actual temperatures.
Figure 9B:
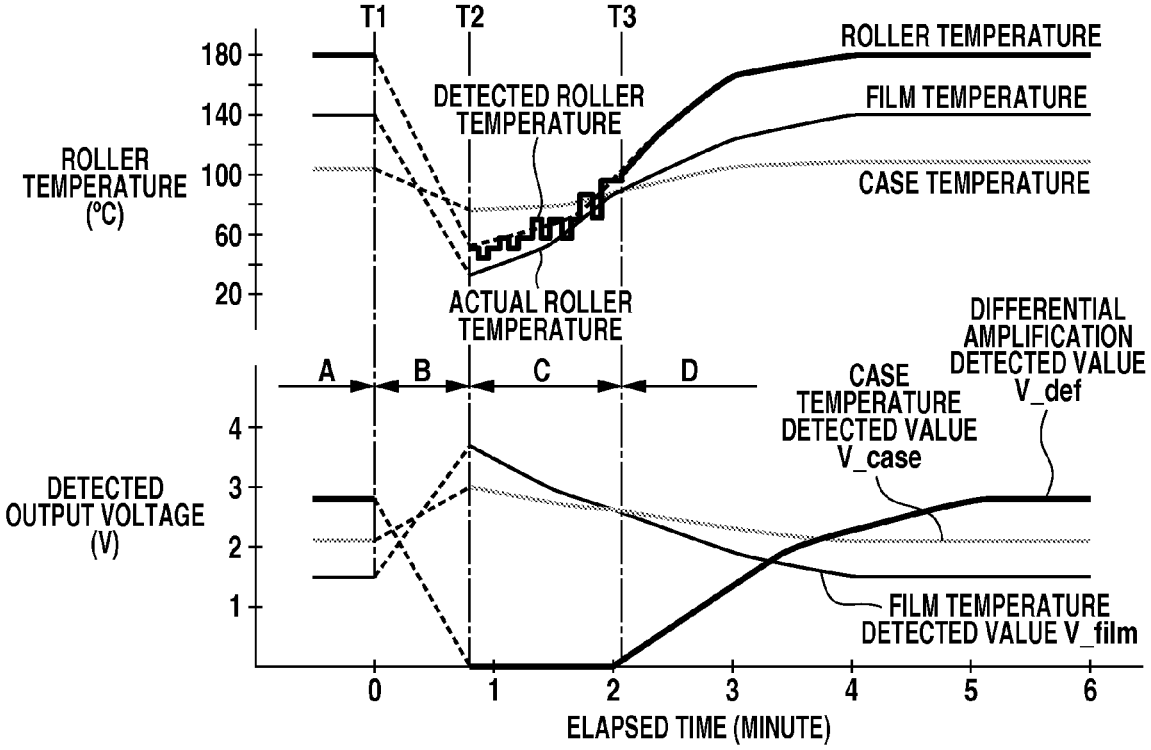
FIG. 9B illustrates temperatures of a heating roller detected by the temperature detection sensor according to the first exemplary embodiment and actual temperatures.

FIGS. 9A and 9B illustrate results of comparisons of temperatures of the heating roller 31, film temperatures, and case temperatures, and V_film, V_case, and V_def between a conventional case and the exemplary embodiment. FIG. 9A illustrates a temperature detection result when a conventional configuration was used. FIG. 9B illustrates a temperature detection result according to the present exemplary embodiment.

In the section A, the heating roller 31 was maintained at a fixing temperature (180° C.). In the section A, a film temperature of the temperature detection element 34 was about 140° C., a case temperature was about 100° C., and a differential amplification detected value V_def was (V_case−V_film)×10=V_def>Vth. In this case, the CPU 57 selected the normal data (FIG. 6), and detected a surface temperature of the heating roller 31 based on V_def and V_film.

Next, a case where replacement operation of the heater 33 was started, and the operation was completed in a very short time is described. When the replacement operation of the heating roller 31 was completed in the section B from time T1 to time T2, a temperature of the new heating roller 31 was about a room temperature. However, the case temperature decreased to only around 80° C. At that time, differential amplification detected value V_def was (V_case−V_film)×10=Vth. In this case, the CPU 57 selected the reversion data (FIG. 7), and detected a surface temperature of the heating roller 31 based on V_film and V_case.

Since the resolution of the temperature data table (FIG. 7) at the time of the temperature reversion is low, in the section C, the detected roller temperature shows stepwise detected value change. If there is a difference between an actual surface temperature and a detected temperature of the heating roller 31, the film temperature exceeds the case temperature before the temperature of the heating roller 31 excessively increases. This prevents the heating roller 31 from abnormal surface temperature increase.

In the section C, as the roller temperature gradually increased, the film temperature increased, and at time T3, the temperature became (V_case−V_film)×10=V_def>Vth. Then, the CPU 57 selected the normal data (FIG. 6), and detected the surface temperature of the heating roller 31 (section D). In the normal data, the resolution of the detected temperature is sufficiently high, and the roller temperature can be accurately detected. That is, when the surface temperature of the heating roller 31 increases and the film temperature becomes a temperature higher than the case temperature, based on the normal data (FIG. 6), the surface temperature of the heating roller 31 is accurately detected.

In this exemplary embodiment, the heating roller 31 can be replaced as described above. Also in a structure where the heater 33 can be replaced, a similar problem may occur. That is, when the heater 33 is replaced and the CPU 57 detects that the case temperature is higher than the film temperature, according to the exemplary embodiment, the surface temperature of the heating roller 31 can be accurately detected.

In the temperature detection processing in FIG. 8, in step S102, whether the differential amplification detected value V_def is larger than the threshold value Vth is determined. Alternatively, for example, whether V_case is larger than V_film may be determined. In such a configuration, if V_case is larger than V_film, the CPU 57 determines that the film temperature is higher than the case temperature, and based on V_def and V_film, the CPU 57 detects a temperature of the heating roller 31. On the other hand, if V_case is not larger than V_film, the CPU 57 determines that the film temperature is lower than the case temperature, and based on V_film and V_case, the CPU 57 detects a temperature of the heating roller 31.

Alternatively, for example, a configuration which determines whether V_case is a predetermined value or more larger than V_film can be employed. In such a configuration, if V_case is the predetermined value or more larger than V_film, based on V_def and V_film, the CPU 57 detects a temperature of the heating roller 31. On the other hand, if V_case is not the predetermined value or more larger than V_film, based on V_film and V_case, the CPU 57 detects a temperature of the heating roller 31.

According to the present exemplary embodiment, even if the temperature of the film is lower than the temperature of the sensor itself, the temperature of the fixing member can be accurately detected. For example, when the fixing member is replaced, the temperature of the fixing member can be accurately detected.

Hereinafter, the second exemplary embodiment is described. In the first exemplary embodiment, after a difference (Vdef) between a case temperature and a film temperature becomes larger than the threshold value, when the temperature difference (Vdef) becomes smaller than the threshold value again, the CPU 57 determines a temperature of the heating roller 31 using the second table. In this exemplary embodiment, after a difference (Vdef) between a case temperature and a film temperature becomes larger than a threshold value, even if the temperature difference (Vdef) becomes smaller than the threshold value, the CPU 57 determines a temperature of the heating roller 31 using the first data table. For this purpose, the first data table includes data of V_def showing values under Vth. When the heating roller 31 is replaced, the CPU 57 determines whether a difference (Vdef) between a film temperature and a case temperature is larger than the threshold value. If the difference (Vdef) between the film temperature and the case temperature is larger than the threshold value, the CPU 57 determines a temperature of the heating roller 31 using the second data table again.

Figure 10A:
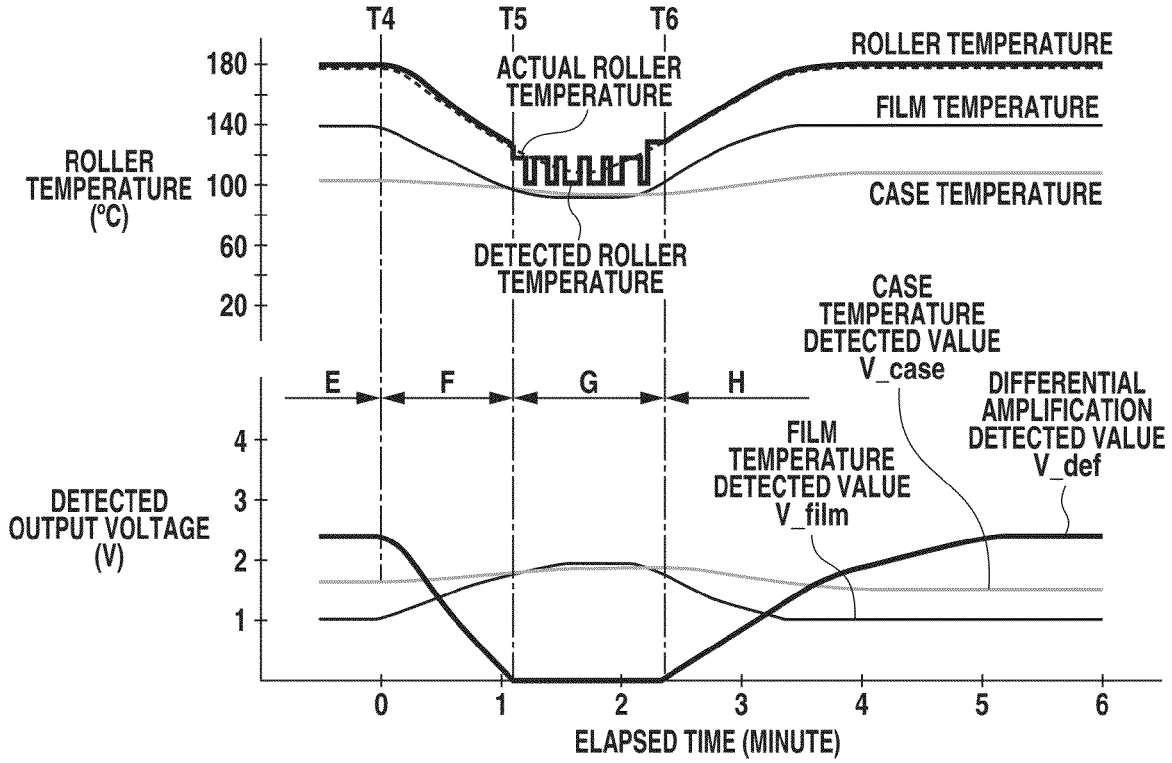
FIG. 10A illustrates temperatures of the heating roller detected by the temperature detection sensor according to the first exemplary embodiment.
Figure 10B:
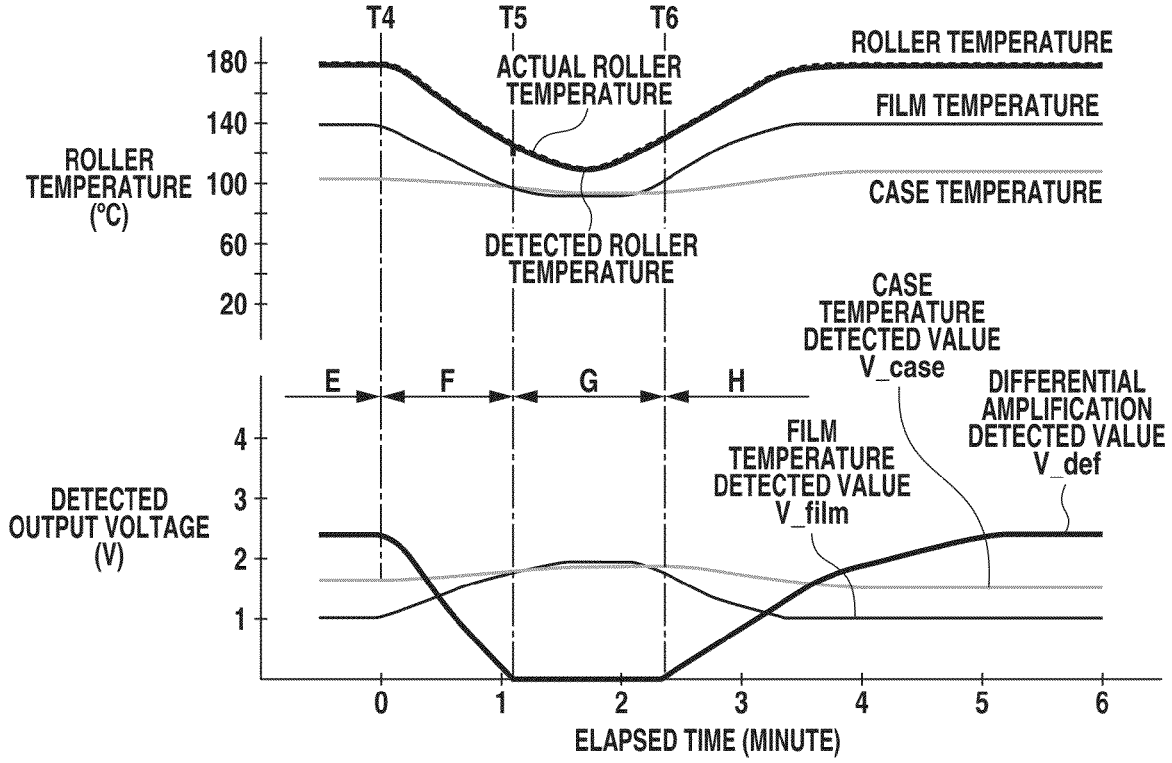
FIG. 10B illustrates temperatures of the heating roller detected by the temperature detection sensor according to the second exemplary embodiment and actual temperatures.

FIG. 10A and/or FIG. 10B illustrate(s) a temperature transition of the heating roller 31 after an image was fixed on thick paper of grammage of, for example, 280 g/m$^3$ or more. The grammage and heat capacity have a proportional relation. That is, the heat capacity of the thick paper is larger than plain paper showing grammage of, for example, 280 g/m$^3$. FIG. 10A illustrates the temperature of the heating roller 31 determined by the CPU 57 in the first exemplary embodiment. FIG. 10B illustrates the temperature of the heating roller 31 determined by the CPU 57 according to this exemplary embodiment.

In the section E, the temperature of the heating roller 31 was maintained at a fixing temperature (180° C.). In the section E, a film temperature of the temperature detection element 34 was about 140° C., a case temperature was about 100° C., and a differential amplification detected value V_def was larger than a threshold value Vth. (V_case−V_film)×10=V_def>Vth.

In such a case, in the first exemplary embodiment, and in this exemplary embodiment, the CPU 57 selected the first data table (FIG. 6), and detected a surface temperature of the heating roller 31 based on V_def and V_film. The resistance values of the thermistors 44 and 45 decrease as the detected temperatures increases, and consequently, as the detected temperatures increase, the output voltage (V_film, V_case) decreases.

At the timing T4, a printing operation was started. By this operation, the pressure roller 32 was pressed against the heating roller 31. At this time, the temperature of the pressure roller 32 was lower than the temperature of the heating roller 31. At the section F, the thick paper passed through the fixing unit 26, and the temperature of the heating roller 31 further decreased.

In section F, the film temperature decreased to about 90° C. Meanwhile, the case temperature decreased to only around 95° C. Consequently, the case temperature was higher than the film temperature. As a result, a differential amplification detected value V_def was (V_film−V_case)×10=V_def≤Vth. In the first exemplary embodiment, the CPU 57 selects the second data table (FIG. 7), and determines a surface temperature of the heating roller 31 based on V_film and V_case. Moreover, in the section G, the film temperature and the case temperature are substantially the same, and a difference V_def between a voltage output by the thermistor 44 and a voltage output by the thermistor 45 is sometimes larger or sometimes smaller than the threshold value Vth. Consequently, in the first exemplary embodiment, in the section G, the temperature of the heating roller 31 is determined using the first data table, or the temperature of the heating roller 31 is determined using the second table.

The resolution of the second data table (FIG. 7) is lower than that of the first data table (FIG. 6), and as illustrated by the solid line in FIG. 10A, in the section G, the temperature of the heating roller 31 shows stepwise temperature change. Since the temperature of the heating roller 31 repeatedly increases and decreases, the CPU 57 may incorrectly determine that the heater 33 is out of order, and may prohibit the execution of the image forming operation.

In the section H, the temperature of the heating roller 31 increased, and at time T6 the film temperature became higher than the case temperature, (V_case−V_film)×10=V_def>Vth. In the first exemplary embodiment, the CPU 57 selects the first data table (FIG. 6), and determines a surface temperature of the heating roller 31. That is, when the surface temperature of the heating roller 31 increases and the film temperature becomes higher than the case temperature, based on the first data table (FIG. 6), the surface temperature of the heating roller 31 is accurately detected.

In this exemplary embodiment, after a differential amplification detected value V_def becomes lower than the threshold value Vth, when once the differential amplification detected value V_def becomes higher than the threshold value Vth, based on the first data table (FIG. 6), a surface temperature of the heating roller 31 is determined.

By this operation, as illustrated in FIG. 10B, when the film temperature and the case temperature change, also in the section G in which (V_case−V_film)×10=V_def≤Vth, the first data table (FIG. 6) is selected. Consequently, the temperature of the heating roller 31 does not change stepwise so that the CPU 57 does not incorrectly determine that the heater 33 is out of order, and the execution of the image forming operation is not prohibited.

In this exemplary embodiment, the heating roller 31 can be replaced. Also in a structure where the heater 33 can be replaced, a similar problem may occur. That is, when the heater 33 is replaced and the CPU 57 detects that the case temperature is higher than the film temperature, according to the exemplary embodiment, the surface temperature of the heating roller 31 can be accurately detected.

In the second exemplary embodiment, whether the differential amplification detected value V_def is larger than the threshold value Vth is determined. Alternatively, for example, whether V_case is larger than V_film can be determined. In such a case, if V_case is larger than V_film, the CPU 57 determines that the film temperature is higher than the case temperature, and based on V_def and V_film, the CPU 57 detects a temperature of the heating roller 31. On the other hand, if V_case is not larger than V_film, the CPU 57 determines that the film temperature is lower than the case temperature, and based on V_film and V_case, the CPU 57 detects a temperature of the heating roller 31.

Alternatively, for example, a configuration which determines whether V_case is a predetermined value or more larger than V_film can be employed. In such a configuration, if V_case is the predetermined value or more larger than V_film, based on V_def and V_film, the CPU 57 detects a temperature of the heating roller 31. On the other hand, if V_case is not the predetermined value or more larger than V_film, based on V_film and V_case, the CPU 57 detects a temperature of the heating roller 31.

According to the present exemplary embodiment, after a surface temperature of the heating roller 31 decreases, even in a transition period during which a difference (Vdef) between a case temperature and a film temperature becomes larger or smaller than the threshold value, it can be prevented that the surface temperature of the heating roller 31 changes stepwise.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-008935 filed Jan. 21, 2014, and No. 2014-255164 filed Dec. 17, 2014 which is hereby incorporated by reference herein in its entirety.

What is claimed is:

1. An image forming apparatus comprising:

a fixing unit having a heater, and a fixing member configured to be heated by the heater, the fixing unit configured to heat a recording material bearing an image using the fixing member so that the image is fixed on the recording material;

a film provided in non-contact with the fixing member, the film configured to increase its temperature by absorbing infrared rays emitted from the fixing member;

a first sensor configured to measure a temperature of the film;

a holding member configured to hold the film;

a second sensor configured to measure a temperature of the holding member;

a storage unit for storing corresponding relations among information about measurement results of the first sensor and measurement results of the second sensor, and the temperature of the fixing member, as a plurality of temperature determination information wherein the plurality of temperature determination information has the different corresponding relations;

a selection unit configured to select temperature determination information to interest, based on the measurement results of the first sensor and the measurement results of the second sensor, from among the plurality of the temperature determination information stored in the storage unit; and a determination unit configured to determine a temperature of the fixing member using the temperature determination information to interest selected by the selection unit, based on the measurement results of the first sensor and the measurement results of the second sensor.

2. The image forming apparatus according to claim 1, wherein the storage unit stores first temperature determination information indicating a corresponding relation between the information and the temperature of the fixing member, and second temperature determination information in which the corresponding relation between the information and the temperature of the fixing member is different from the first temperature determination information, and the selection unit, based on the measurement result of the first sensor and the measurement result of the second sensor, selects one of the first temperature determination information and the second temperature determination information.

3. The image forming apparatus according to claim 2, wherein the temperature determination information is a table, the first temperature determination information is a table for determining a temperature of the fixing member based on a difference between the measurement result of the first sensor and the measurement result of the second sensor, and the measurement result of the first sensor, and the second temperature determination information is a table for determining a temperature of the fixing member based on the measurement result of the first sensor and the measurement result of the second sensor.

4. The image forming apparatus according to claim 2, wherein the selection unit further comprises an output circuit configured to output an output value corresponding to a difference between the measurement result of the first sensor and the measurement result of the second sensor, the selection unit selects the first temperature determination information in a case where the output value output by the output circuit is larger than a threshold value, and the selection unit selects the second temperature determination information in a case where the output value is smaller than the threshold value.

5. The image forming apparatus according to claim 4, wherein the determination unit, in a case where the first temperature determination information is selected by the selection unit, using the first temperature determination information, based on the output value and the measurement result of the first sensor, determines a temperature of the fixing member, and the determination unit, in a case where the second temperature determination information is selected by the selection unit, using the second temperature determination information, based on the measurement result of the first sensor and the measurement result of the second sensor, determines a temperature of the fixing member.

6. The image forming apparatus according to claim 4, wherein the output circuit includes an amplifier circuit configured to amplify the difference between the measurement result of the first sensor and the measurement result of the second sensor.

7. The image forming apparatus according to claim 4, wherein, in a case where the first temperature determination information is selected by the selection unit after the second temperature determination information is selected by the selection unit, even if a second temperature corresponding to the measurement result of the second sensor becomes higher than a first temperature corresponding to the measurement result of the first sensor, the selection unit does not select the second temperature determination information again.

8. The image forming apparatus according to claim 7, wherein, in the fixing unit, the heater can be replaced, and the selection unit selects the second temperature determination information, after the heater is replaced, if the second temperature corresponding to the measurement result of the second sensor is higher than the first temperature corresponding to the measurement result of the first sensor.

9. The image forming apparatus according to claim 7, wherein, in the fixing unit, the fixing member can be replaced, and the selection unit selects the second temperature determination information, after the fixing member is replaced, if the second temperature corresponding to the measurement result of the second sensor is higher than the first temperature corresponding to the measurement result of the first sensor.

10. The image forming apparatus according to claim 1, wherein, in the fixing unit, the heater can be replaced.

11. The image forming apparatus according to claim 1, further comprising:

a controller configured to control the temperature of the heater based on the temperature of the fixing member determined by the determination unit.

12. An image forming apparatus comprising:

an image forming unit configured to form an image on a recording material;

a fixing unit including a heating portion configured to heat the image formed on the recording material, configured to fix the image onto the recording material by using the heating portion;

a film arranged by not being in contact with the heating portion, configured to increase a temperature thereof by absorbing infrared rays emitted from the heating portion;

a first sensor configured to measure a temperature of the film; a case disposed by not being in contact with the heating portion and having the film therein;

a second sensor configured to measure a temperature of the case;

a determining unit configured to determine a temperature information of the heating portion according to a measurement result of the first sensor and a measurement result of the second sensor based on a first temperature determination condition in a case where a first temperature corresponding to the measurement result of the first sensor is higher than a second temperature corresponding to the measurement result of the second sensor, and determine a temperature information of the heating portion according to a measurement result of the first sensor and a measurement result of the second sensor based on a second temperature determination condition that is different from the first temperature determination condition in a case where the first temperature is lower than the second temperature; and a controller configured to control a temperature of the heating portion based on the temperature information determined by the determining unit.

13. The image forming apparatus according to claim 12, wherein the determining unit obtains data regarding a temperature difference based on the first temperature and the second temperature, and wherein, in a case where the first temperature is higher than the second temperature, the determining unit determines the temperature information from the measurement result of the first sensor and the data based on the first temperature determination condition.

14. The image forming apparatus according to claim 12, further comprising:

a storage unit in which the first temperature determination condition and the second temperature determination condition are stored, wherein the first temperature determination condition and the second temperature determination condition are tables.

15. The image forming apparatus according to claim 14, wherein the first temperature determination condition is a table indicating a correspondence relation among, a difference between the measurement result of the first sensor and the measurement result of the second sensor, the measurement result of the first sensor, and the temperature information, and wherein the second temperature determination condition is a table indicating a correspondence relation between, a relationship of the measurement result of the first sensor and the measurement result of the second sensor, and the temperature information.

16. The image forming apparatus according to claim 12, wherein the heating portion is replacably provided to the image forming apparatus.

17. The image forming apparatus according to claim 16, wherein the determining unit determines the temperature information based on the second temperature determination condition at a first period, the first period is a period after the heating portion is replaced and while the second temperature is higher than the first temperature, the first period is included in a predetermined period, the predetermined period is a period from when the heating portion is replaced until the heating portion is once again replaced, the determining unit determines the temperature information based on the first temperature determination condition at a second period, the second period is a period after the first period and while the first temperature is higher than the second temperature, the second period is included in the predetermined period, the determining unit determines the temperature information based on the first temperature determination condition at a third period, the third period is a period after the second period and while the second temperature is higher than the first temperature, and the third period is included in the predetermined period.

* * * * *